United States Patent [19]

Terkelsen

[11] 3,931,847

[45] Jan. 13, 1976

[54] METHOD AND APPARATUS FOR PRODUCTION OF DIRECTIONALLY SOLIDIFIED COMPONENTS

[75] Inventor: Bruce E. Terkelsen, Cheshire, Conn.

[73] Assignee: United Technologies Corporation, Hartford, Conn.

[22] Filed: Sept. 23, 1974

[21] Appl. No.: 508,303

[52] U.S. Cl. ..... 164/4; 164/60; 164/154; 164/361

[51] Int. Cl.[2] ..... B22D 25/06

[58] Field of Search ..... 164/4, 60, 122, 125, 127, 164/154, 338, 361

[56] References Cited

UNITED STATES PATENTS

| | | | |
|---|---|---|---|
| 3,532,155 | 10/1970 | Kane et al. | 164/60 |
| 3,680,625 | 8/1972 | Hein et al. | 164/60 X |
| 3,770,047 | 11/1973 | Kirkpatrick et al. | 164/60 X |
| 3,794,100 | 2/1974 | Raymond et al. | 164/127 X |

FOREIGN PATENTS OR APPLICATIONS

| | | | |
|---|---|---|---|
| 2,085,254 | 12/1971 | France | 164/60 |

*Primary Examiner*—R. J. Shore
*Assistant Examiner*—John E. Roethel
*Attorney, Agent, or Firm*—Charles A. Warren

[57] ABSTRACT

In the manufacture of cast articles such as gas turbine blades and vanes from high temperature alloys or eutectics, the heating of the mold in readiness for pouring and the cooling of the mold after pouring are precisely controlled by mechanism responsive to thermocouples internal and external to the mold and moving with the mold and a thermocouple in fixed relation within the furnace. The mechanism is especially adapted for use with the withdrawal technique in which the mold when poured is withdrawn from within the heating furnace past a radiation baffle thereby maintaining a steep thermal gradient within the mold and moving relative to the mold to establish the rate of upward movement of the solidification front within the alloy.

20 Claims, 4 Drawing Figures

METHOD AND APPARATUS FOR PRODUCTION OF DIRECTIONALLY SOLIDIFIED COMPONENTS

BACKGROUND OF THE INVENTION

In heating the mold within a furnace or heating chamber in readiness for pouring, the temperature of the interior of the mold lags behind the outer surface of the mold by reason of the thermal characteristics of the ceramic of the mold. If the furnace is controlled to continue heating at a maximum rate until the interior of the mold reached pouring temperature, the furnace may become so hot as to cause damage to the exterior of the mold by the high temperature developed. Measurement of the interior of the mold has generally been difficult since positioning of a thermocouple at the inner surface of the mold without interfering with the casting has been difficult or impossible.

It is desirable both economically and for mold quality to use the shortest possible heating time. Degradation of the mold may occur during high temperature preheating of the mold in a vacuum especially if such preheating takes an excessive time. Prior to the present invention very long preheat times were required to be sure the mold was completely heated to the desired temperature, particularly the alloy contacting surfaces. This long term heating frequently damaged the mold resulting in inclusions in the castings which are a cause for rejection of the cast part.

In the withdrawal technique, the mold, when poured, is withdrawn from within the furnace past a heat control baffle at such a rate as to cause the solidification front to move upwardly within the alloy at the desired rate for making columnar grained articles at the same time maintaining a steep thermal gradient in the alloy at and directly above the solidification front. In the past, there has been no additional heating of the furnace to maintain this high thermal gradient during the mold withdrawal. There has also been no adequate measure of the rate of cooling of the alloy so that the rate of withdrawal during and after solidification of the alloy has been generally established by trial and error.

SUMMARY OF THE INVENTION

One feature of the invention is a control of the heating process for the mold, and a control of temperatures after pouring so that the process may be more precisely controlled than before. Another feature is an instrumentation of the mold and apparatus so as to determine accurately the several critical temperatures and control the casting process accordingly.

According to the invention, the mold is made with a thermocouple cavity extraneous to the article forming cavities in the mold so that the temperature of the interior of the mold may be measured particularly during the heating process. The mold has an accommodation for a second thermocouple to be located close to the exterior surface of the mold and to move with the mold during the mold withdrawal. A third thermocouple is located in fixed relation within the furnace and close to the mold surface when the mold is in the furnace so as to sense the furnace temperature to which the mold is exposed. These thermocouples supply temperature indications to a suitable recorder/controller that controls the furnace temperature during the casting process and the withdrawal of the mold at the completion of the casting process.

The foregoing and other objects, features, and advantages of the present invention will become more apparent in the light of the following detailed description of preferred embodiments thereof as illustrated in the accompanying drawing.

DESCRIPTION OF THE PREFERRED EMBODIMENT

Figure 1:
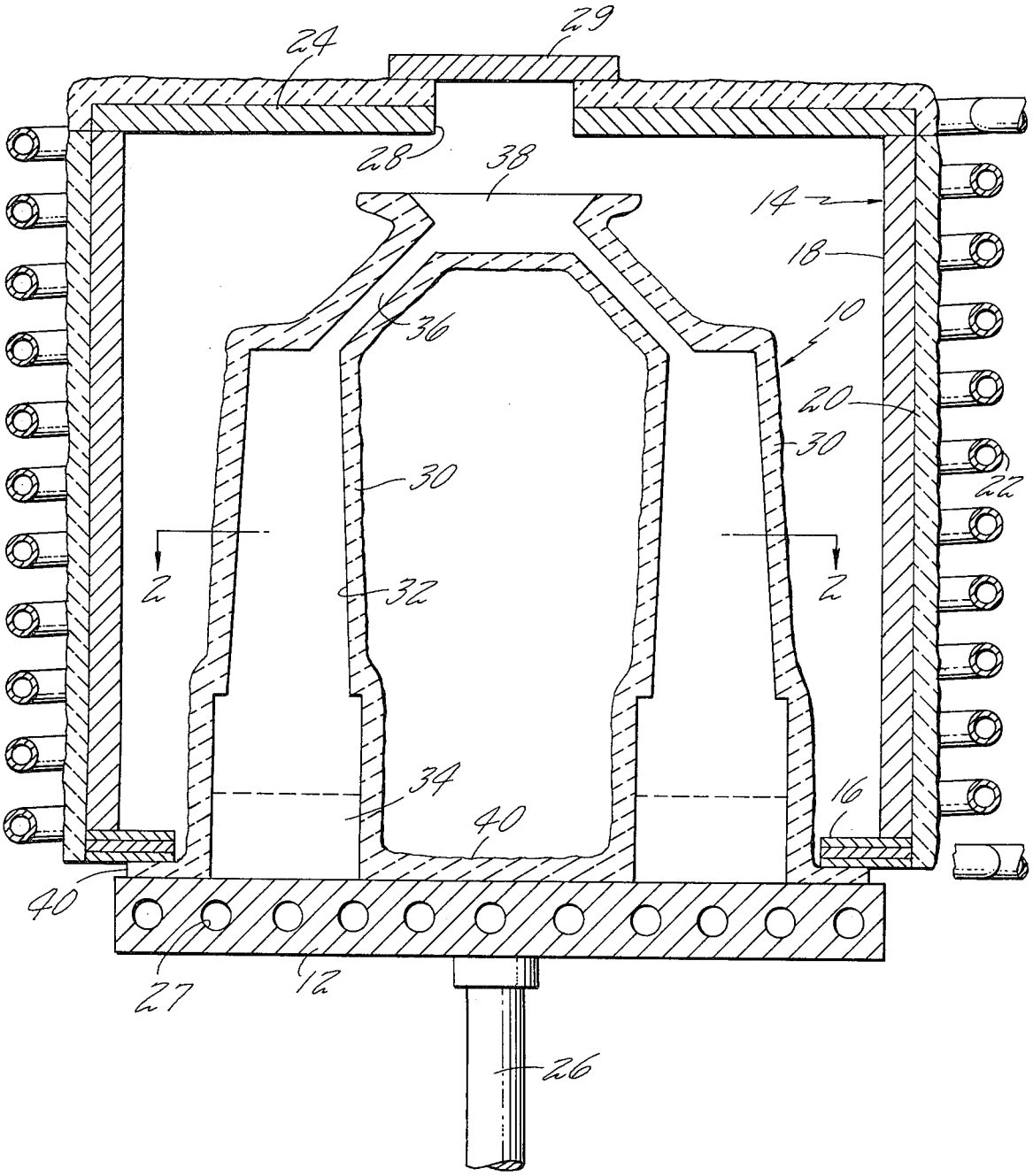
FIG. 1 is a vertical sectional view through a mold and casting apparatus.

The invention is shown in casting apparatus utilizing the withdrawal technique in which a mold 10 positioned on a chill plate 12 is located within a suitable heating chamber 14 so that the mold may be heated prior to pouring at least to the melting point of the alloy being cast. After the alloy is poured the chill plate with the mold thereon is withdrawn from the chamber 14 past a heat control baffle 16 to cause unidirectional solidification of the alloy first by the effect of the chill plate and then by radiation of heat from the mold. When the alloy is vacuum cast, the apparatus is enclosed within a vacuum chamber, not shown, and when the mold is exposed below the heat control baffle 16, heat is radiated from the mold to the cooled walls of the chamber.

The heating chamber is shown as an induction heated chamber including a susceptor 18 forming the side wall of the chamber and resting on the baffle 16. The susceptor is surrounded by suitable insulation such as graphite felt 20 and the chamber is within the induction 22. A cover plate 24 closes the top of the chamber and the chill plate located below the baffle closes the bottom of the chamber. This chill plate is mounted on a shaft 26 which may be electromechanically actuated and by which the chill plate, with the mold thereon, may be withdrawn at a selected rate from the chamber. The chill plate has coolant passages 27 therein. The cover plate 24 has a central opening 28 for pouring the alloy in the mold, and this opening is closed by a movable plate 29 during preheating of the mold.

The mold 10 is shown as a multiple mold for casting several articles at one time, four in the arrangement shown. The mold shown by way of example is used in casting turbine blades, and each section 30 thereof includes an article cavity 32, a growth cavity 34 at the bottom open to the chill plate and a filler passage 36 at the top communicating with a common filler spout 38. A flange 40 at the base of the growth section provides for fastening the mold to the chill plate.

The mold shown is one made by the well known lost-wax process in which the shell of ceramic material is built up by several dip coats formed successively one after another by dipping the wax pattern assembly in a ceramic slurry, coating the wet pattern with a dry granular ceramic and then drying the coated pattern. After several successive coatings and dryings a shell of the necessary thickness is ready for firing to harden the successive coatings and for removal of the wax pattern.

The arrangement shown is particularly adapted for producing columnar grained articles as described in VerSnyder U.S. Pat No. 3,260,505, or the specific type of columnar grain, the single crystal article, of Piearcey U.S. Pat. No. 3,494,709, and has use in the casting of high temperature superalloys, examples of which are given in these two patents. The arrangement also has utility in the production of articles from eutectics as described in Lemkey U.S. Pat. No. 3,793,010. It is understood that the apparatus also may be utilized in production of equiaxed cast articles where high quality of cast material and dimension are requirements.

The mold has, in addition to the structure above described, a vertically extending hollow post 42, made at the same time as the remainder of the mold so as to have the same density, thermal conductive characteristics and thickness. It may be made by adding a rod of wax to the remainder of the wax pattern assembly prior to the formation of the mold thereon. This post thus has a vertical recess 44 therein terminating adjacent to the top end of the article cavities of the main mold and is arranged to receive a thermocouple 45 therein. This thermocouple includes the heat sensing contact bead 46 on the ends of the conductive wires 48 extending upwardly from the chill plate from and through a hole 49. These wires may be supported within the chill plate so as to hold the thermocouple in position as by a compression fitting 50 on the underside of the plate. This thermocouple senses the temperature within the mold cavities and will closely indicate when the alloy contacting surfaces of the article cavities have reached the desired temperature for pouring the mold, this temperature being generally a selected amount, for example 200°F, above the melting temperature of the alloy.

Closely adjacent to the post 42 is a vertical opening 52 in the mold so arranged as to permit the positioning of a second thermocouple 54 with the heat sensing contact bead 56 external to the mold but close to the bead 46. This thermocouple is exposed to the heat within the heating chamber 14 and is used to establish the desired temperature outside of the mold during mold heating. This thermocouple limits the maximum temperature of the chamber thereby preventing overheating of the mold and limiting the thermal stresses within the mold material. This thermocouple has the bead 56 supported in the location shown by the connecting wires 57 which extend upwardly from and are supported in the chill plate. The wires extend through a vertical hole 58 in the chill plate and are held in position as by a compression fitting 59.

A third thermocouple 60 is also supported within the heating chamber 14 and is also located so that the bead 62 is adjacent to the other thermocouple beads. The conductive wires 64 for this thermocouple are shown as extending downwardly from the cover 24 through a hole 65 and are supported therein as by a compression fitting 66 to hold the bead in the desired location. This thermocouple serves as the temperature sensor for the heater process control.

In operation, a mold having been placed in position on the chill plate, the latter is moved into the position shown within the chamber. This also places thermocouple 54 close to thermocouple 60 so that both these thermocouples may sense the temperature of the heating chamber or the radiant heat of the heater.

The chamber is heated by a supply of electricity to the induction coil 22 from a source 67 through the heater power control 68 and leads 70. The temperature as sensed by thermocouple 60 is fed back through lead 71 to a recorder controller 72 and the temperatures as sensed by thermocouples 45 and 54 are fed through leads 74 and 76, respectively, to the recorder controller.

With the mold in the heating chamber the heating is continued under the control of thermocouple 54. When this thermocouple indicates the desired mold heating temperature is reached, for example 2750°F for certain nickel base superalloys, the recorder controller 72 adjusts the set point of the power control through lead 78 so that the chamber temperature will not go beyond this point.

At this time, the temperature within the mold has lagged considerably below the surface temperature. During the subsequent mold equilibrium soak period, the termperature difference between thermocouples 45 and 54 decreases until both indicate the same temperature, for example 2750°F. The mold is then ready to pour. This equilibrium of thermocouples 45 and 54 is indicated by suitable recorders in the recorder controller 72.

Immediately before pouring, the set point of the recorder controller is matched to the temperature of thermocouple 60 and switched to automatically maintain the heater temperature, as measured by thermocouple 60, at the desired point during the mold withdrawal process. It will be understood that, after pouring the mold, as solidification begins at the chill plate, the plate and mold thereon are withdrawn downwardly past the radiation baffle, to obtain the desired solidification rate in the molten alloy. During this withdrawal, the thermocouple 60 activates the control 68 to increase energy to the heater thereby maintaining the necessary temperature within the chamber to provide the high thermal gradient in the mold at the level of the baffle.

In certain cases it becomes desirable to increase the heater temperature as measured by thermocouple 60, during mold withdrawal, according to a predetermined schedule in order that the most effective thermal gradient may be produced at the baffle. This may vary depending on the size, shape and height of the mold and the alloy to be cast. This schedule is established by the power control 68 and is under the control of thermocouple 60 which remains in position within the heater during mold withdrawal.

Figure 2:
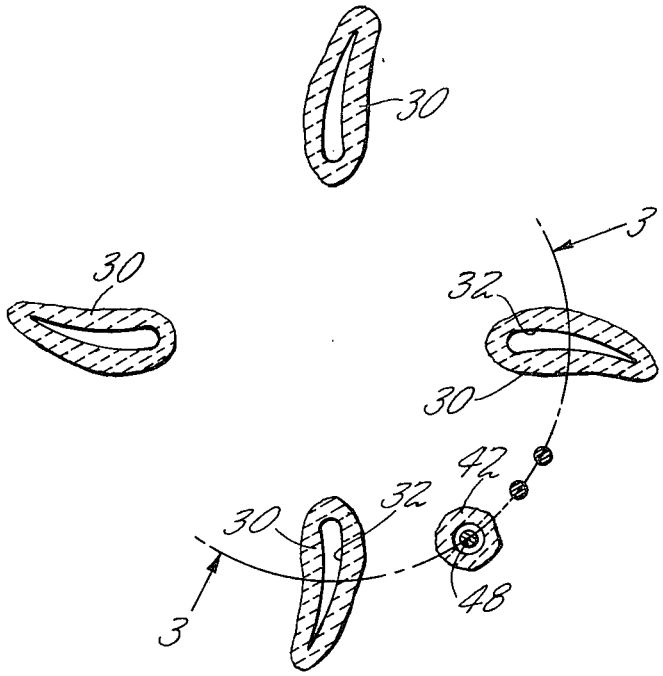
FIG. 2 is a horizontal sectional view along line 2—2 of FIG. 1.
Figure 4:
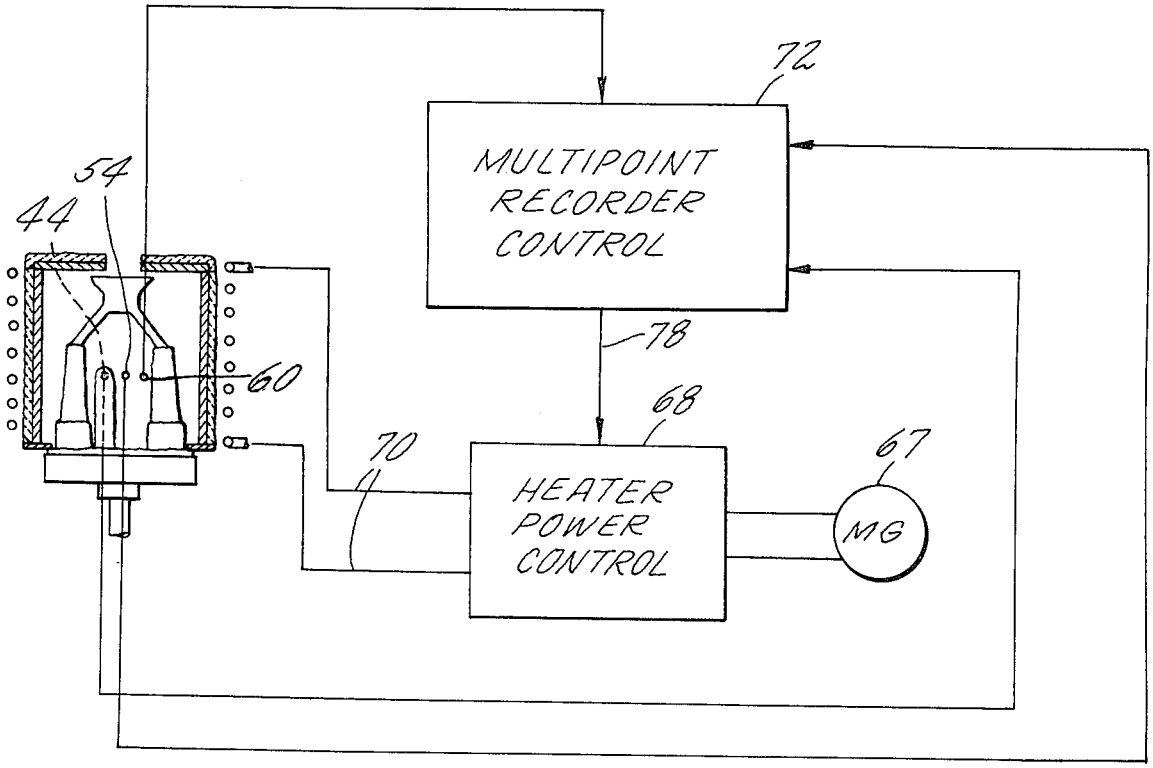
FIG. 4 is a schematic drawing of a control.
Figure 3:
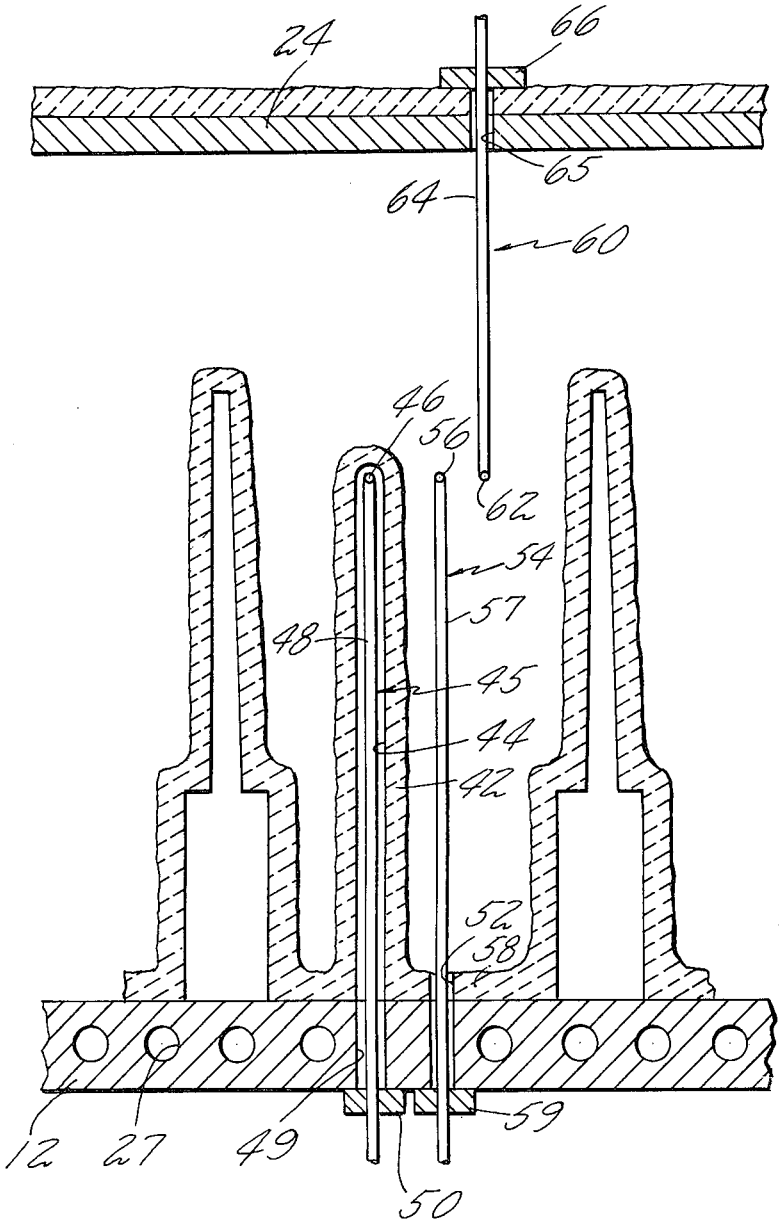
FIG. 3 is a sectional view along line 3—3 of FIG. 2.

It will be noted, as shown in FIGS. 2 and 3 that the several thermocouples are all located substantially at equal distances from the wall of the heating chamber, and preferably at equal radii from the center of the chamber, these radii being equal approximately to the spacing of the mid point of the article cavity from the center of the chamber as clearly shown in FIG. 2.

It will be understood that the invention is equally applicable to a single article mold as well as a mold cluster shown, and that other forms of mold heating may be utilized. Essentially the arrangement described eliminates operator error by preventing excessive heater temperatures during mold heating and by indicating when the mold cavities have reached the desired casting temperature. By maintaining the highest desirable heating temperature, and by indicating the arrival of the mold cavities at the desired pouring temperature, the necessary time and temperature controls for best mold quality and best cast article quality are provided and such controls reduce the casting cycle time to a minimum.

When solidification is complete, as indicated by thermocouples 45 and 54, the mold is quickly withdrawn for removal from the chill plate. A new mold is then placed on the plate, moved up into heating chamber 14 and the process is repeated.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of my invention, that which I claim as new and desire to secure by Letters Patent of the United States is:

1. In the manufacture of columnar grained articles the steps of providing a ceramic mold in which the article is to be cast, said mold including a mold cavity other than the article cavity to receive a thermocouple, positioning the mold on a chill plate with the mold in a furnace, positioning another thermocouple externally of the mold and adjacent to the thermocouple cavity of the mold, placing a second thermocouple in said therocouple cavity, providing a third thermocouple in said furnace for controlling the furnace temperature, heating the furnace for heating the mold therein with the third thermocouple limiting the maximum temperature to a selected temperature, continuing heating of the mold until the second thermocouple indicates that the interior of the mold has reached the desired temperature for pouring, pouring the alloy in the mold, withdrawing the mold slowly in a controlled manner from the furnace to cause an upward movement of a thermal gradient along the mold for solidifying the alloy, maintaining the heat within the furnace under control of the third thermocouple, and rapidly completing the mold withdrawal when the first thermocouple indicates a temperature below the melting point of the alloy.

2. The process of claim 1 in which the cavity in the mold extends upward from the mold base in parallel relation to an article cavity in the mold.

3. The process of claim 1 in which the first and second thermocouples extend upwardly from the chill plate.

4. The process of claim 1 including the step of providing a baffle at the base of the furnace and extending inwardly substantially to the mold for establishing the desired steep thermal gradient.

5. The process of claim 1 including the additional step of supporting the first and second thermocouples from the chill plate so that these thermocouples move with the chill plate and mold during mold withdrawal.

6. A mold for use in casting columnar grained articles including at least one article cavity in vertical position, a filler opening for said cavity, a growth cavity at the bottom of the article, said growth cavity being open at the base of the mold to be closed by a chill plate, and a thermocouple cavity in parallel relation to said article cavity, said thermocouple cavity being open at the base of the mold to receive a thermocouple when the base of the mold is placed on a chill plate and the periphery of the base of the thermocouple cavity engaging the chill plate to keep the cavity free of metal when the mold is filled.

7. A mold as in claim 6 in which the mold base has an opening therein to receive a second thermocouple, said opening permitting insertion of said second thermocouple when the mold is placed on a chill plate.

8. A mold as in claim 6 in which the thermocouple cavity terminates at a height adjacent the top of the article cavity.

9. A mold as in claim 6 in which the mold thickness for the thermocouple cavity is the same as the mold thickness for the article cavity.

10. A mold as in claim 6 in which the thermocouple cavity is a vertical passage extending upwardly from the base and terminating at a point adjacent to the upper end of the article cavity.

11. Apparatus for casting columnar grained articles including a chill plate, at least two thermocouples supported by said chill plate and extending upwardly therefrom, in combination with a mold having a base to rest on the chill plate, said mold having an article cavity open at the base to the chill plate, a thermocouple cavity independent of the article cavity and extending in a vertical direction from said mold base substantially parallel to the article cavity, said thermocouple cavity being open at the base of the mold to receive one of said thermocouples the base of the mold closely surrounding the end of the thermocouple cavity engaging the chill plate to keep this cavity free of molten metal when the article cavity is filled, and said mold base having another opening to extend around said other thermocouple when placed on the chill plate.

12. Apparatus as in claim 11 in which the thermocouple cavity has a wall thickness comparable to the article cavity.

13. Apparatus as in claim 11 in which the thermocouple cavity extends to a height substantially that of the article cavity.

14. Apparatus as in claim 11 in which the thermocouple cavity is out of communication with the cavities of the mold that are filled with the alloy.

15. Apparatus as in claim 11 in which the thermocouple cavity is of such a dimension as to receive the thermocouple slidably therein.

16. Apparatus for casting columnar grained articles including providing a mold having an article forming cavity therein and a second cavity open at the bottom of the mold and extending substantially in parallel spaced relation to the article cavity, heating means for heating a mold including a chamber to receive the mold, a chill plate closing the lower end of the chamber and on which the mold is positioned, said chill plate closing the bottom ends of the cavities and making them independent cavities so that molten metal in the article cavity does not enter the second cavity, 17. Apparatus as in claim 16 including means for withdrawing the chill plate with the mold thereon after the mold is poured to remove the mold from the chamber and a third thermocouple located adjacent to said second thermocouple and externally of the mold to indicate when the alloy is solidified, said third thermocouple being carried by said chill plate and moving therewith.

18. Apparatus as in claim 16 including a baffle at the lower end of the chamber and extending over the chill plate almost into contact with the mold, and means for withdrawing the chill plate with the mold thereon to remove the mold from the chamber.

19. Apparatus as in claim 18 including a third thermocouple mounted on the chill plate adjacent to said second thermocouple and external to the mold for indicating when the alloy is solidified.

20. Apparatus as in claim 19 including heat control means responsive to said first thermocouple, temperature indicating means responsive to said second thermocouple, and temperature indicating means responsive to said third thermocouple.

* * * * *

UNITED STATES PATENT OFFICE

CERTIFICATE OF CORRECTION

PATENT NO. : 3,931,847

DATED : January 13, 1976

INVENTOR(S) : Bruce E. Terkelsen

It is certified that error appears in the above-identified patent and that said Letters Patent are hereby corrected as shown below:

Column 1, line 12: "reached" should read --reaches--.

Column 2, line 36: after "induction" insert --coil--.

Column 5, line 23: "therocouple" should read --thermocouple--.

Claim 16, column 6, line 58: after "cavity," insert

-- a first thermocouple positioned in fixed relation in the chamber to sense the temperature therein, control means responsive to said thermocouple to control said heating means, a second thermocouple extending upwardly from the chill plate and adapted to be received in the second cavity in the mold, and means for indicating the pouring temperature of the mold by said second thermocouple. --

Signed and Sealed this

*thirteenth* Day of *April 1976*

[SEAL]

*Attest:*

RUTH C. MASON
*Attesting Officer*

C. MARSHALL DANN
*Commissioner of Patents and Trademarks*